US005332981A

United States Patent [19]

Mazzochette et al.

[11] Patent Number: 5,332,981

[45] Date of Patent: Jul. 26, 1994

[54] TEMPERATURE VARIABLE ATTENUATOR

[75] Inventors: Joseph B. Mazzochette, Cherry Hill; John R. Steponick, Clayton, both of N.J.

[73] Assignee: EMC Technology, Inc., Cherry Hill, N.J.

[21] Appl. No.: 923,862

[22] Filed: Jul. 31, 1992

[51] Int. Cl.[5] ..... H01P 1/22

[52] U.S. Cl. ..... 333/81 R; 333/81 A

[58] Field of Search ..... 333/81 R, 81 A, 22 R; 338/216

[56] References Cited

U.S. PATENT DOCUMENTS

| | | | |
|---|---|---|---|
| 2,604,803 | 1/1953 | Howard | 333/22 R |
| 2,677,109 | 4/1954 | Bowers, Jr. et al. | 333/22 R |
| 2,704,348 | 3/1955 | Carlin | 333/22 R |
| 2,717,299 | 9/1955 | Jacobi | 333/22 R |
| 2,777,995 | 1/1957 | Henning | 333/22 |
| 2,855,570 | 10/1958 | Gallagher | 333/22 R |
| 3,059,201 | 10/1962 | Saad | 333/22 R |
| 3,810,048 | 5/1974 | Baril et al. | 333/22 R |
| 4,020,427 | 4/1977 | Connerney et al. | 333/22 R |
| 4,156,215 | 5/1979 | Stager | 333/22 R |
| 4,310,812 | 1/1982 | DeBloois | 333/81 A |
| 4,799,031 | 1/1989 | Lang et al. | 333/22 R |
| 4,942,375 | 7/1990 | Petitjean et al. | 333/81 R |

*Primary Examiner*—Raymond A. Nelli

*Attorney, Agent, or Firm*—Norman E. Lehrer

[57] ABSTRACT

An absorptive temperature variable microwave attenuator is produced utilizing at least two different thick film resistors. The temperature coefficients of the resistors are different and are selected so that the attenuator changes at a controlled rate with changes in temperature while the impedance of the attenuator remains substantially constant. Substantially any temperature coefficient of resistance can be created for each resistor by properly selecting and mixing different inks when forming the thick film resistors. Furthermore, attenuators can be created having either a negative temperature coefficient of attenuation or a positive temperature coefficient of attenuation.

13 Claims, 1 Drawing Sheet

TEMPERATURE VARIABLE ATTENUATOR

BACKGROUND OF THE INVENTION

The present invention is directed toward a temperature variable attenuator and more particularly toward an absorptive-type temperature variable microwave attenuator wherein the attenuation thereof changes at a controlled rate with changes in temperature while the impedance remains substantially constant.

Attenuators are used in applications that require signal level control. Level control can be accomplished by either reflecting a portion of the input signal back to its source or by absorbing some of the signal in the attenuator itself. The latter case is often preferred because the mismatch which results from using a reflective attenuator can create problems for other devices in the system such as nonsymmetrical two-port amplifiers. It is for this reason that absorptive attenuators are more popular, particularly in microwave applications.

The important parameters of an absorptive attenuator are its accuracy as a function of frequency, its return loss and its stability over time and temperature. It is known that variations in temperature can affect various component parts of a microwave system causing differences in signal strengths at different temperatures. Much time, effort and expense has gone into the components of such systems in an effort to stabilize them over various temperature ranges. This has greatly increased the cost of microwave systems that must be exposed to wide temperature ranges.

It is common today to find thermistors used in many types of electronic circuits. They are often employed as temperature compensating elements in analog circuits and as detectors in temperature probes. Most thermistor applications are at frequencies of a few hundred megahertz or below. To Applicant's knowledge, no one has ever considered utilizing the attributes of a thermistor in a microwave attenuator circuit that is usable up to 6 GHz or more.

SUMMARY OF THE INVENTION

Rather than attempt to stabilize the signal level of a microwave circuit by optimizing each component part thereof, the present invention contemplates that the signal level will vary over temperature and controls the same utilizing a temperature variable attenuator. The absorptive-type temperature variable microwave attenuator of the present invention is produced utilizing at least two different thick film resistors. The temperature coefficients of the resistors are different and are selected so that the attenuator changes at a controlled rate which changes with temperature while the impedance of the attenuator remains substantially constant. Substantially any temperature coefficient of resistance can be created for each resistor by properly selecting and mixing different inks when forming the thick film resistors. Furthermore, attenuators can be created having either a negative temperature coefficient of attenuation or a positive temperature coefficient of attenuation.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
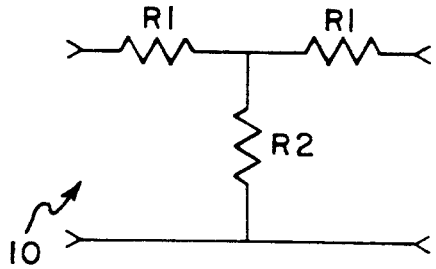
FIG. 1 is a schematic representation of a microwave attenuator.

Referring now to the drawings in detail, FIG. 1 is a schematic representation of an absorptive microwave attenuator 10 commonly used in the industry and referred to as a T attenuator. Attenuator 10 includes a pair of identical series resistors R1 and a shunt resistor R2.

Figure 2:
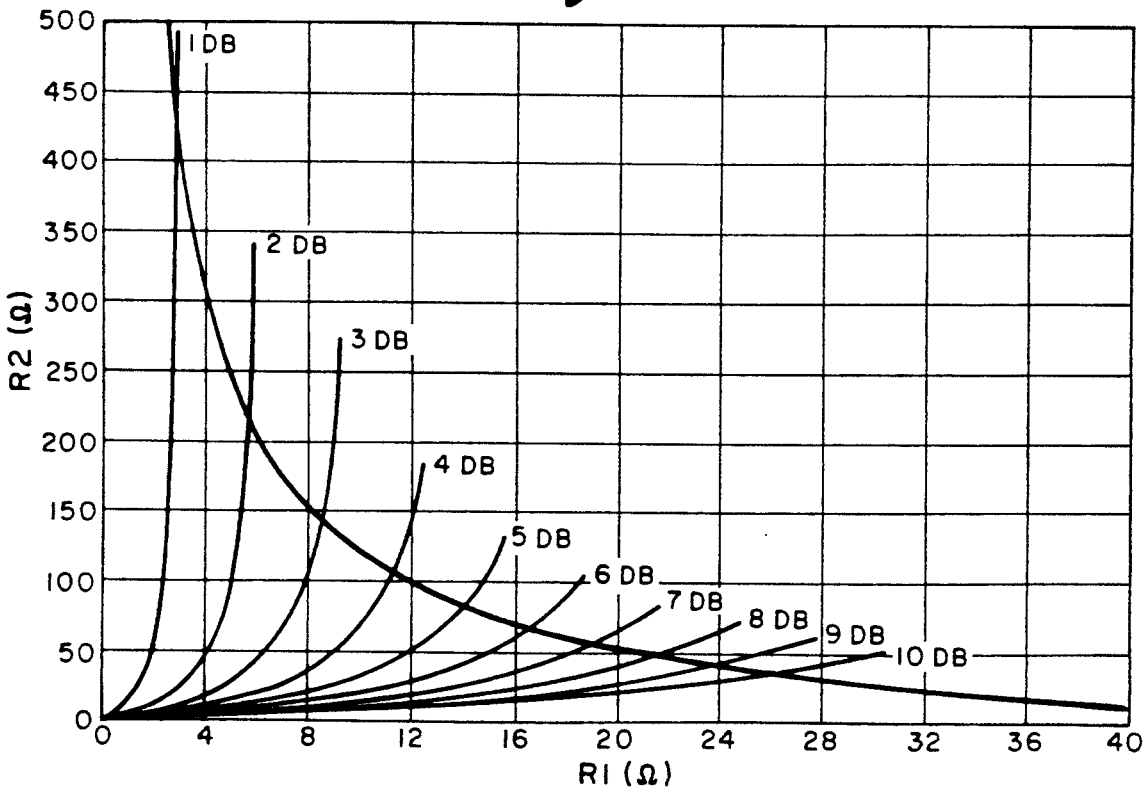
FIG. 2 is a plot showing a family of constant attenuation curves utilized in designing the attenuators of the present invention.

FIG. 2 is a plot showing a family of constant attenuation curves from 1 to 10 dB, with a constant 50Ω impedance curve. The vertical axis on this plot represents the values of resistor R2 and the horizontal axis represents the values for resistor R1. The point of intersection between the impedance curve and an attenuation curve gives the values for R1 and R2 that produce the desired attenuation and a 50Ω impedance match.

FIG. 2 is useful in determining the proper design for a temperature variable attenuator. The plots in the figure show how the resistors R1 and R2 must change in order to produce a change in attenuation while maintaining a good match. The plots also provide useful insight into parameter sensitivity.

For example, it can be seen that the accuracy of low value attenuators is more sensitive to variations in R1 than R2. For a 1 dB attenuator, a 10 percent increase in R1 causes a 0.05 dB increase in the attenuation, while a 10 percent increase in R2 only increases the attenuation by 0.004 dB. Variations in R1 and R2 produce about the same amount of accuracy degradation in larger value attenuators. However, the polarity of attenuation shift for large attenuators is positive for increasing values of R1 and negative for increasing values of R2. Furthermore, the impedance of the attenuator is more sensitive to changes in R1 than R2 for large value attenuators. A 10 percent increase in R1 for a 10 dB pad will cause the impedance to increase to 54.3Ω, while a 10 percent increase in R2 causes the impedance to rise to only about 50.8Ω.

In a manner which will be explained more fully hereinafter, the values of the resistors R1 and R2 for a temperature variable attenuator which will produce the proper attenuation at the high and low temperature extremes can be determined from the curves of FIG. 2. Once the values are determined, it is necessary to select a resistor material that will produce the resistance shift required. In order to address all of the possible combinations of attenuation values and temperature shift that may be required, a flexible resistor system must be used. The currently preferred form is a thick film resistor system that is currently employed in the manufacture of thermistors.

Thick film resistors are produced by combining a metal powder, such as Bismuth Ruthenate, with glass frit and a solvent vehicle. This solution is deposited and then fired onto a ceramic substrate which is typically alumina. When the resistor is fired, the glass frit melts and the metal particles in the powder adhere to the substrate, and to each other.

One of the advantages of this type of a resistor system is that a few ranges of material resistivities and temperature characteristics may be blended together to produce many different combinations. A disadvantage, however, is that the glass frit in the resistor can produce a parasitic capacitive reactant that can make the high resistivity materials unusable at high frequencies. Careful resistor design and ink selection can result in a temperature variable attenuator that can operate to 6 GHz.

The resistive characteristics of a thick film ink is specified in ohms per square area (Ω/■). This quantity is a function of the material resistivity of typical fired thickness. The value of a rectangular resistor can be predicted using the following relation:

$$R = \Omega/\blacksquare\,(L/W)$$

Where:

L=The resistor length

W=The resistor width

A particular resistor value can be achieved by either changing the geometry of the resistor pattern or by blending inks with different Ω/■ in nearly linear proportions to produce the desired characteristic. The resistance can be fine-tuned by varying the fired thickness of the resistor. This can be accomplished by changing the deposition thickness and/or the firing profile. Similar techniques can be used to change the temperature characteristics of the ink. However, variations in geometry have little effect on this parameter. Most thick film manufacturers specify the temperature characteristics of a resistive ink in terms of the ink $\beta$:

$$\beta = \left(\frac{T_2 \times T_1}{T_2 - T_1}\right)\ln\left(\frac{R_{T2}}{R_{T1}}\right)$$

Where:

$R_{T1}$=resistance of a sample @the low temperature, T1

$R_{T2}$=resistance of a sample @the high temperature, T2

$T_1$=lower temperature in ° K $T_2$=higher temperature in ° K

A more convenient definition for the temperature characteristic of the ink is the Temperature Coefficient of Resistance (TCR) often expressed in parts per million per degree Centigrade (PPM/C). TCR is determined by the following:

$$TCR = \frac{(R_{T2} - R_{T1})}{R_{T1}(T2 - T1)}(1 \times 10^6)$$

The above factor can be used to calculate directly the amount of shift that can be expected from a resistor over a given temperature range. Once the desired TCR for a particular application is determined it can be achieved by blending appropriate amounts of different inks. As with blending for sheet resistance, a TCR can be formed by blending two inks with TCR's above and below the desired TCR. One additional feature of TCR blending is that positive and negative TCR inks can be combined to produce large changes in the resulting material.

One problem that has previously been encountered when using thermistors is the variant nature of the resistance-temperature characteristic. Aside from the nonlinear relationship, thermistors also exhibit a resistance hysteresis as a function of temperature. If the temperature of the resistor is taken beyond the crossover point at either end of the hysteresis loop, the resistor will retain a "memory" of this condition. Consequently, as the temperature is reversed, the resistance will not change in the same manner observed prior to reaching the crossover point. To avoid this problem, the inks used in producing a temperature variable attenuator should be selected with crossover points that are well beyond the −55° C. to 125° C. operating range.

The values for resistors R1 and R2 of FIG. 1 for a temperature variable attenuator that will produce the attenuation at the high and low temperature extremes can be determined from the curves of FIG. 2. The resistor values are first selected to give the desired attenuation at 25° C. which are represented in FIG. 2. Then a TCR is selected for each of the three resistors that will produce the desired amount of attenuation for a particular temperature extreme, while staying on the 50Ω impedance line of FIG. 2.

By way of example, a 4 dB attenuator with a temperature coefficient of attenuation of 0.002 dB/(dB°C.) would have the following attenuation and resistor values at 25° and 125° C.:

| | 25° C. | 125° C. |
|---|---|---|
| Attenuation = | 4 dB | 4.8 dB |
| R1 = | 11 Ω | 13.5 Ω |
| R2 = | 105 Ω | 86 Ω |

This example would require that R1 have a TCR of 2270 PPM/°C. while R2 would need a TCR of −1800 PPM/°C. This selection required that the series resistors R1 and the shunt resistor R2 have opposing TCR's.

The value of the attenuator at the opposite temperature extreme can be calculated using the parameters determined by the foregoing. For the example set forth above, the calculated values at −55° C. are:

| | −55° C. |
|---|---|
| Attenuation = | 3.2 dB |
| R1 = | 9 Ω |
| R2 = | 120 Ω |

Using the following equation for linear regression, the slope of the calculated design can be compared with the desired slope. For the straight line: y=ax+b $$aN + b\Sigma x_i = \Sigma Y_i$$

$$a\Sigma x_i + b\Sigma x_i = \Sigma(y_i x_i)$$

Where:

a=Slope b=y intercept

N=Number of data points $x_i$=The i'th temperature reading.

$y_i$=The i'th attenuation reading.

For the example, the slope calculated from the linear regression is 0.0022 dB/(dB°C.). The resistor values and resistor TCR's can then be adjusted to minimize the difference between the two slopes. In the example the slopes differed by nine percent. If the resistor selection for the 125° C. temperature are reduced by two percent the new values are:

| | 25° C. | 125° C. | −55 | TCR |
|---|---|---|---|---|
| Attenuation: = | 4 dB | 4.7 dB | 3.3 dB | |
| R1: = | 11 Ω | 13.2 Ω | 9.24 Ω | 2000 |
| R2: = | 105 Ω | 88 Ω | 118.6 Ω | −1690 |

A linear regression on the above data gives a slope of 0.00193 dB/(dB°C.) which is very close to the design goal of 0.002.

Figure 3:
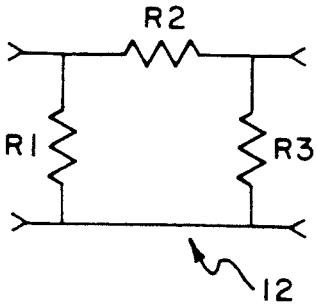
FIG. 3 is a schematic representation of a second form of microwave attenuator.

FIG. 3 is a schematic representation of another form of a temperature variable attenuator in accordance with the present invention and has been designated generally as 12. The temperature variable attenuator 12 is commonly referred to as a pi-type attenuator and a physical embodiment of the same is shown in perspective in FIG. 4.

Figure 4:
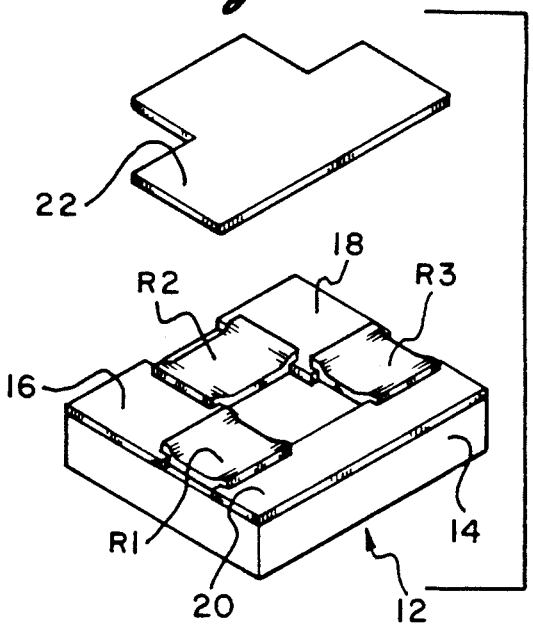
FIG. 4 is a partially exploded perspective view of the attenuator shown in FIG. 3.

Two temperature variable attenuators were made conforming to FIGS. 3 and 4. Both had nominal values of 4 dB@25° C. and each had a temperature coefficient of attenuation of 0.002 dB/(dB° C.). However, the two examples had opposite temperature coefficients. That is, one increased with increases in temperature while the other decreased.

In each of the two examples, R1 and R3 had values of 221Ω while resistor R2 had a value of 24Ω. The temperature coefficient of resistivity of resistors R1 and R3 in both examples was 100 PPM/°C. In the temperature variable attenuator having a positive temperature coefficient of attenuation, the TCR of R2 was 2700 PPM/°C. while R2 in the temperature variable attenuator having a negative TCA had a TCR of −2640. Furthermore, in both examples, the resistivity of resistors R1 and R3 was 200Ω/■ while the resistivity of resistor R2 was 50Ω/■.

Referring now to FIG. 4 which shows a typical attenuator construction identified at 12, a substrate of approximately 96 percent aluminum oxide is used as the base 14. Of course, other insulating materials such as reinforced Teflon, fiberglass board or beryllia ceramic may be used. Three metal conductor pads 16, 18 and 20 are applied to the base 14. The size and position of the pads is determined by the value of the required resistors. To achieve the required resistor values for the examples, the equation set forth above is used which takes into account the length and width and resistivity of the resistor materials.

The length of the resistors is determined by the distance between the pads. The distance between pads 16 and 20 determines the length of resistor R1; the distance between pads 16 and 18 determines the length of resistor R2; and the distance between pads 18 and 20 determines the length of resistor R3. The width of each conductor pad is preferably made slightly larger (0.005") than the required resistor width in order to keep the resistor values constant over process and fixture tolerances.

The conductor pads 16, 18 and 20 are preferably made from thick film platinum gold which is deposited on the ceramic base 14 by screen printing in a known manner. Thick film resistors R1, R2 and R3 having the specifications described above and of the proper width and length are then applied also utilizing a screen printing procedure and are then fired in a manner well known in the art. Preferably, the thick film resistors R1, R2 and R3 are then protected from abrasion with a silicone base protective coating 22.

Important to the performance of the temperature variable attenuator is the maintenance of a good match (VSWR) over temperature. This match can be attained by selecting the resistor TCR's that keep the ratio between the series resistor R2 and the shunt resistors R1 and R3 constant over temperature.

The present invention may be embodied in other specific forms without departing from the spirit or essential attributes thereof and accordingly reference should be made to the appended claims rather than to the foregoing specification as indicating the scope of the invention.

We claim:

1. A temperature variable microwave attenuator comprised of at least first and second resistors, said first resistor having temperature coefficient of resistance which is different from the temperature coefficient of resistance of said second resistor, the temperature coefficients of said resistors being such that the attenuation of said attenuator changes at a controlled rate with changes in the ambient temperature but wherein the impedance of said attenuator remains substantially constant as said attenuation changes.

2. The invention as claimed in claim 1 wherein one of said resistors has a negative temperature coefficient of resistance and the other of said resistors has a positive temperature coefficient of resistance.

3. The invention as claimed in claim 1 wherein said resistors are film resistors.

4. The invention as claimed in claim 3 wherein said resistors are thick film resistors.

5. The invention as claimed in claim 1 wherein said attenuator has a negative temperature coefficient of attenuation.

6. The invention as claimed in claim 1 wherein said attenuator has a positive temperature coefficient of attenuation.

7. In an absorptive microwave attenuator comprised of at least first and second resistors, the improvement comprising means for changing the attenuation of said attenuator with changes in ambient temperature, said means including said first resistor having a temperature coefficient of resistance which is different from the temperature coefficients of resistance of said second resistor, the temperature coefficient of said resistors being such that the impedance of said attenuator remains substantially constant as said attenuation changes.

8. The improvement as claimed in claim 7 wherein the attenuation of said attenuator changes at a controlled rate with changes in the ambient temperature.

9. The improvement as claimed in claim 8 wherein one of said resistors has a negative temperature coefficient of resistance and the other of said resistors has a positive temperature coefficient of resistance.

10. The improvement as claimed in claim 8 wherein said resistors are film resistors.

11. The improvement as claimed in claim 10 wherein said resistors are thick film resistors.

12. The improvement as claimed in claim 8 wherein said attenuator has a negative temperature coefficient of attenuation.

13. The improvement as claimed in claim 8 wherein said attenuator has a positive temperature coefficient of attenuation.

* * * * *

US005332981C1

(12) EX PARTE REEXAMINATION CERTIFICATE (8234th)

United States Patent

Mazzochette et al.

(10) Number: US 5,332,981 C1

(45) Certificate Issued: May 17, 2011

(54) TEMPERATURE VARIABLE ATTENUATOR

(75) Inventors: Joseph B. Mazzochette, Cherry Hill, NJ (US); John R. Steponick, Clayton, NJ (US)

(73) Assignee: EMC Technology LLC, Cherry Hill, NJ (US)

Reexamination Request:
No. 90/007,118, Jul. 12, 2004

Reexamination Certificate for:

| | |
|---|---|
| Patent No.: | **5,332,981** |
| Issued: | **Jul. 26, 1994** |
| Appl. No.: | **07/923,862** |
| Filed: | **Jul. 31, 1992** |

(51) Int. Cl.
*H01P 1/22* (2006.01)

(52) U.S. Cl. ..... 333/81 R; 333/81 A

(58) Field of Classification Search ..... None
See application file for complete search history.

(56) References Cited

U.S. PATENT DOCUMENTS

| | | | | |
|---|---|---|---|---|
| 2,855,570 A | | 10/1958 | Gallagher | 333/22 R |
| 3,680,013 A | | 7/1972 | Pye | 333/81 R |
| 3,805,209 A | | 4/1974 | Keranen | 338/76 |
| 4,132,863 A | | 1/1979 | Smith | 379/400 |
| 4,138,637 A | | 2/1979 | Weinert | 323/354 |
| 4,156,215 A | | 5/1979 | Stager | 333/81 A |
| 4,260,965 A | | 4/1981 | Nakamura et al. | 333/81 A |
| 4,310,812 A | | 1/1982 | DeBloois | 333/81 A |
| 4,475,099 A | * | 10/1984 | Praria | 338/195 |
| 4,685,799 A | * | 8/1987 | Brininstool | 356/73.1 |
| 4,965,538 A | | 10/1990 | Mickey | 333/81 A |
| 5,194,834 A | | 3/1993 | Bacher et al. | 333/81 A |
| 5,448,103 A | | 9/1995 | de Wit | 257/536 |
| 5,486,787 A | * | 1/1996 | Maekawa et al. | 327/560 |

FOREIGN PATENT DOCUMENTS

| | | |
|---|---|---|
| DE | 3429888 | 2/1986 |
| JP | 58-237028 | 12/1983 |
| JP | 57-74526 | 2/1986 |
| JP | 02-034013 | 7/1988 |
| JP | 1990-69138 | 6/1990 |
| JP | 3-115405 | 11/1991 |
| JP | 4-29227 | 3/1992 |
| JP | 4-117013 | 4/1992 |
| JP | 4-172706 | 6/1992 |

OTHER PUBLICATIONS

Weinert et al, "A 1–18 GHz Attenuator Calibrator", Dec. 1976, vol. IM–25, No. 4.

"Electronic Devices and Circuits", pp. 287–288 (1967).

Kuo Y. Tsai, "Passive Components Compensate Circuits for Thermal Drift", Microwaves & RF, Dec. 1989.

Mazzochette, "Temperature Variable Microwave Attenuators", Microwave Journal, Mar. 1992.

"Wave Generation and Shaping", pp. 708–710 (1970).

Jaffe, "Temperature Compensation Using Thermistors", Microwave and RF, Apr. 1984, pp. 101–104.

Sinclair, "Passive Components", 2nd ed., pp. 204–209 (1991).

Sander, "Microwave Components and Systems", pp. 156–157 (1987).

Rizza, Passive Circuits, pp. 264–269 (1988).

Edwards, Foundations for Microstrip Circuit Design, pp. 267–268 (1991).

(Continued)

*Primary Examiner*—Minh T. Nguyen

(57) ABSTRACT

An absorptive temperature variable microwave attenuator is produced utilizing at least two different thick film resistors. The temperature coefficients of the resistors are different and are selected so that the attenuator changes at a controlled rate with changes in temperature while the impedance of the attenuator remains substantially constant. Substantially any temperature coefficient of resistance can be created for each resistor by properly selecting and mixing different inks when forming the thick film resistors. Furthermore, attentuators can be created having either a negative temperature coefficient of attenuation or a positive temperature coefficient of attenuation.

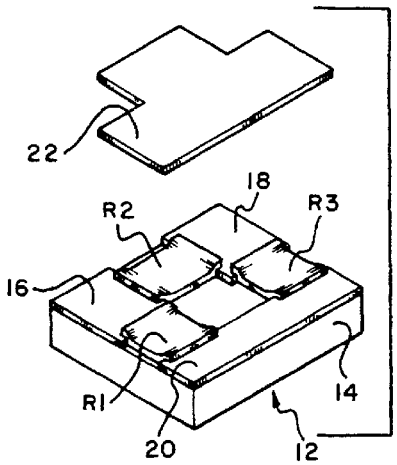

OTHER PUBLICATIONS

Gutierrez, "A Thick Film Package for Microwave ICS", 1992 Proceedings: 42nd Electronic Components & Technology Conference, May 18–20, 1992, pp. 151–156.

Moore, M.T. and Miller, P., "Microwave IC Control Components for Phased–Array Antennas", Electronics & Communication Engineering Journal, pp. 123–130 (1992).

Nagai, T. and Itoh, M., "SIC Thin–Film Thermistors", IEEE: Transactions on Industry Applications, vol. 26, No. 6, Nov. & Dec. 1990, pp. 1139–1143.

* cited by examiner

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-13 are cancelled.

* * * * *